United States Patent [19]

Werner

[11] Patent Number: 5,074,031

[45] Date of Patent: Dec. 24, 1991

[54] TOOL FOR COUPLING AND UNCOUPLING AN ELECTRICAL CONNECTOR

[75] Inventor: Walter M. Werner, Downingtown, Pa.

[73] Assignee: AMP Incorporated, Harrisburg, Pa.

[21] Appl. No.: 323,750

[22] Filed: Jul. 18, 1991

[51] Int. Cl.[5] ..... H01R 43/00

[52] U.S. Cl. ..... 29/747; 29/758; 29/764

[58] Field of Search ..... 29/747, 751, 758, 764

[56] References Cited

U.S. PATENT DOCUMENTS 4,040,179 8/1977 Sanchez ..... 29/747 X

*Primary Examiner*—Carl E. Hall

*Attorney, Agent, or Firm*—Anton P. Ness

[57] ABSTRACT

Tool (10) includes a pair of elongate members (14,26,36) pivotably movable by handles (14) being urged together and apart, for the tool work end (12) to perform coupling and uncoupling operations on a connector assembly (200) placed in either channel (32) or (24) respectively. Each connector (100) is of the type having a rearward section (102) secured on an end of an electrical cable (150), and a forward section (104) including both a blade contact end section (110) and a blade-receiving recess (126) thereby being hermaphroditic and able to be coupled to another like connector (100); the connectors are rotatable about cooperating coupling sections (130) into and out of axial alignment. The tool work end (12) includes a fulcrum embossment (18) along its pivot axis, and a pair of first bosses spaced rearwardly therefrom to define a first or uncoupling channel (24), and a pair of second bosses (30) on prong ends (34) forwardly of fulcrum embossment (18) to define a second or coupling channel (32), with the fulcrum embossment (18) engaging either side edges (120) or side edges (118) of both forward connector sections (104) and the first and second bosses (22,30) engaging respective rearward connector sections (102) to apply opposing forces on selected locations to rotate the connectors.

6 Claims, 6 Drawing Sheets

TOOL FOR COUPLING AND UNCOUPLING AN ELECTRICAL CONNECTOR

FIELD OF THE INVENTION

The present invention relates to the field of electrical connectors and more particularly to tools for coupling and uncoupling electrical connectors for power cable.

BACKGROUND OF THE INVENTION

An electrical connector assembly is known in which a pair of electrical connectors are secured on ends of respective power cables and which are to be mated and unmated. The connectors are hermaphroditic with each being identical to the other. Each has both a blade contact and a blade-receiving recess, with the recess adapted to receive the blade of the other in an assured interference fit. Each connector further includes a pair of camming bosses extending upwardly from an inwardly facing major surface of the blade contact in a direction toward the corresponding inwardly facing surface of the blade contact of the other connector during coupling or mating, and additionally includes an annular boss-receiving camming channel extending into the blade, with the camming bosses disposed along the annular camming channel at locations spaced from each other. During coupling, the connectors are first brought together in with the inwardly facing surfaces of the blade contacts opposing and in abutment with each other, and with the connectors oriented at an angle so that the camming bosses of each connector enter a portion of the camming channel of the other connector angularly spaced from the camming bosses of that connector. The connectors are then rotated into axial alignment with each other, with the blade contact end portion of each connector entering into the blade-receiving recess of the other; the blade contact end portions are axially slit widthwise thereacross permitting incremental reduction in the thickness of the blade contact end portions upon being forced into the corresponding incrementally narrower blade-receiving recesses.

It is desired to provide a tool for urging the connectors into a coupled relationship, and also to provide a tool for uncoupling the coupled connectors.

It is desired for a single tool to perform both coupling and uncoupling of the connectors of the assembly.

SUMMARY OF THE INVENTION

The present invention is a tool adapted to be handheld, having a work end which includes a first connector-receiving channel and a second connector-receiving channel. With a pair of handles capable of being pivoted toward and away from each other about a pivot defining a fulcrum, the work end applies force on a connector assembly placed into a respective one of the connector-receiving channels for coupling or uncoupling of the assembly. The tool can be said to define a first connector-receiving channel between an embossment at the fulcrum and a first pair of bosses spaced therefrom in a first direction, and to define a second connector-receiving channel between the fulcrum embossment and a second pair of bosses spaced therefrom in a second direction opposite from the first direction. With an uncoupled connector assembly placed in the first connector-receiving channel in a proper orientation and having the respective connectors properly deployed at an appropriate relative angle to be mated upon being pivoted, the handles of the tool are manipulated to move a pair of spaced bosses of the tool which in turn engage and urge rearward ends of the connectors to rotate the connectors into axial coalignment about an embossment defined at the fulcrum of the tool which is abutted by forward sections of the connectors of the assembly. With a coupled connector assembly placed in the second connector-receiving channel of the tool in a proper orientation, the handles are manipulated in an opposite direction to move a second pair of spaced bosses of the tool which in turn engage and urge rearward ends of the connectors to rotate the connectors out of axial alignment about the fulcrum embossment.

The work end of the tool can be said to operate in a plane, and the connectors are such as to be rotatable within a plane; the connectors being either coupled or uncoupled are in a proper orientation when the connector rotation plane is parallel to the tool operating plane. With the fulcrum embossment extending outwardly along the tool pivot axis, the connector rotation axis is centered within either the first or second connector-receiving channel and oriented to be parallel with the tool pivot axis and spaced therefrom toward the first or second bosses. Preferably the connectors have boss-receiving recesses, or the first and second bosses can be located along the respective connector-receiving channels to correspond with indentations of the connectors such as would be formed by the connectors being crimped onto the cable ends. During tool pivoting, the first bosses rotate relatively about the fulcrum until the first connector-receiving channel defined by the fulcrum on one side and the bosses on the other has a width equivalent to the width of the coupled connector. Similarly the second bosses rotate relatively about the fulcrum until the second connector-receiving channel is widened from one connector width to a greater dimension allowing for the connectors to assume an angle sufficient to permit uncoupling.

It is an objective of the present invention to provide a hand-operable tool for coupling and uncoupling a pair of connectors secured on cable ends.

An embodiment of the present invention will now be described in detail with reference to the accompanying drawings.

DETAILED DESCRIPTION OF THE PREFERRED EMBODIMENT

Figure 1:
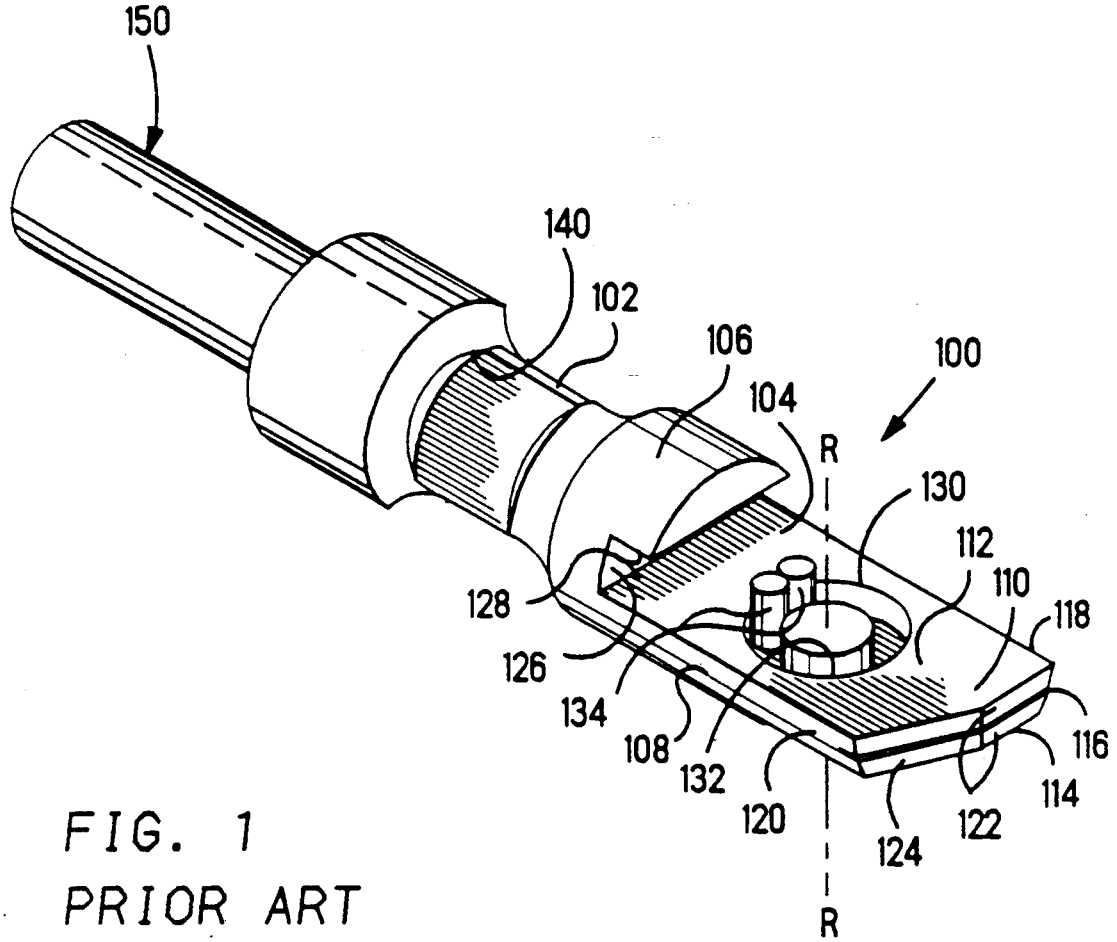
FIG. 1 PRIOR ART
FIG. 1 is a perspective view of a prior art connector of the type for use with which the tool of the present invention is intended.

FIG. 1 illustrates the connector 100 secured onto an end of an electrical conductor cable 150, with connector 100 having an hermaphroditic structure in order that it is matable or couplable to a like connector secured onto another cable to complete an electrical connection between the cables. Connector 100 is shown to have a rearward section 102 which is secured to a stripped end portion of cable 150 by being crimped thereto. Forward connector section 104 includes a blade contact section 106 extending forwardly from base section 108 along one side of the connector to a blade contact end section 110, defining an inwardly facing major surface 112. Blade contact end section 110 has a forward edge surface 114 having a slit 116 of incremental width extending thereinto from side edge 118 to side edge 120 defining tabs 122,122 which are deflectable together under substantial compression; forward edge surface 114 is shown to have an angled portion 124. Extending into base section 108 along major surface 112 is a blade-receiving slot 126 extending from side edge 118 to side edge 120 and having side walls 128, which will receive thereinto a blade contact end section of a mating connector identical to connector 100 during coupling.

In the center of major surface 112 is coupling section 130 comprising an annular camming recess 132 and a pair of camming bosses 134,134. During coupling with a like connector, the camming bosses 134,134 enter the corresponding camming recess of the other connector at an angular location spaced from the camming bosses of the other connector, while the camming bosses of the other connector are simultaneously received into the annular camming recess 132 of connector 100.

When so engaged, the coupling sections of both connectors cooperate to permit pivoting about the aligned centers of the coupling sections so that the angled forward surface portions of the blade contact end sections enter the corresponding blade-receiving recesses whereupon the tabs of the blade contact end sections are urged together under substantial compressive force which must be overcome by substantial pivoting force to couple the connectors together; such substantial compressive force assures an appropriate electrical connection between the connectors for transmission of power levels along coupled cables 150 such as would carry a current of about 1600 amperes. Similarly substantial force must be applied to the respective connectors to uncouple the assembly to overcome the substantial frictional force of the compressed tabs along the recess walls.

Figure 2:
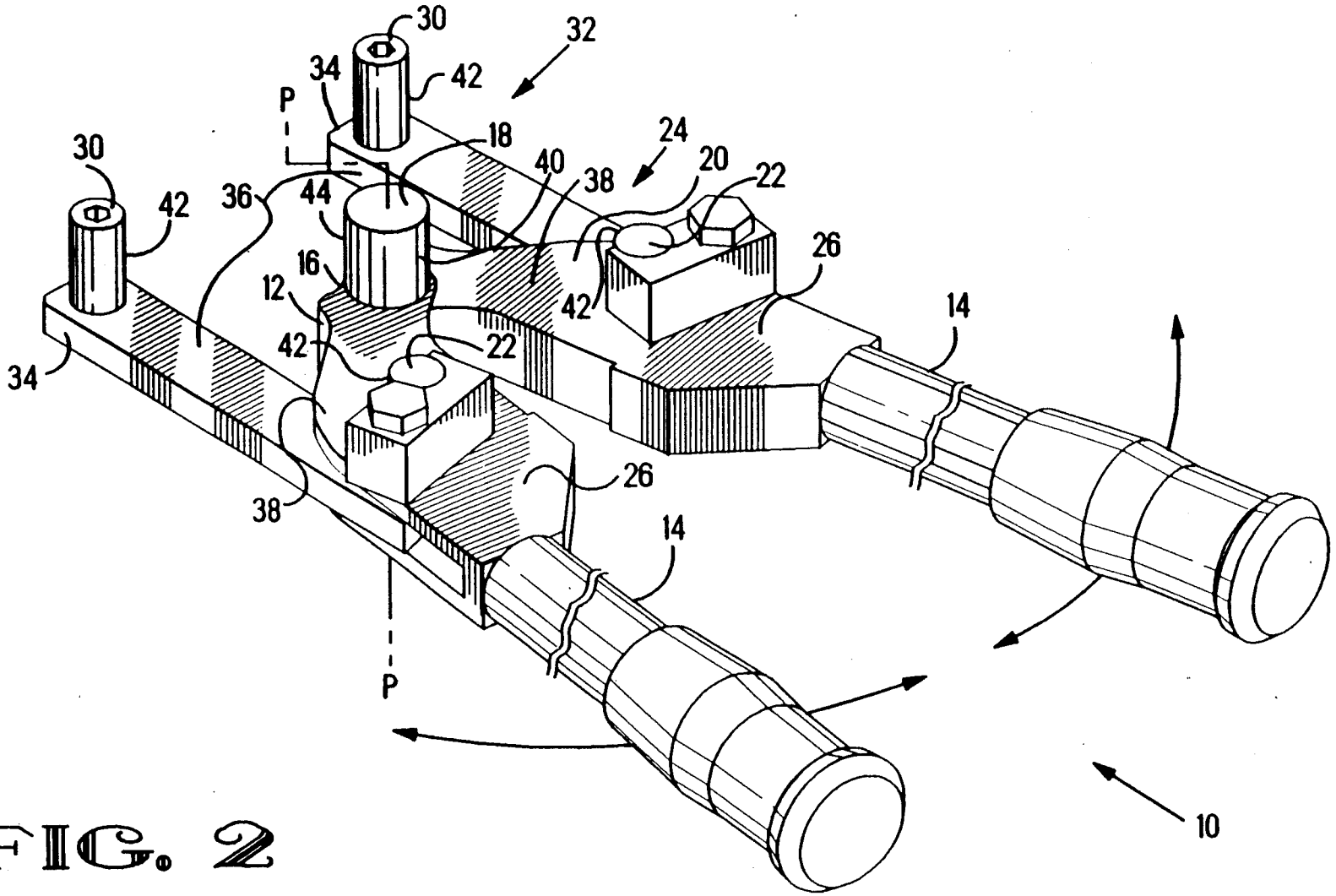
FIG. 2 is an isometric view of the tool of the present invention.

In FIG. 2, tool 10 includes a work end 12 from which extend a pair of handles 14 for manual operation. Handles 14 can be rotated about a pivot 16 in work end 12 to be moved toward each other into a substantially parallel orientation and away from each other in a diverging arrangement. Fulcrum embossment 18 is defined at pivot 16 and extends laterally from work end and outwardly from operating face 20. A pair of first bosses 22 also extend outwardly from operating face 20 spaced rearwardly a selected distance from fulcrum embossment 18 to define a first connector-receiving channel 24 therewith. First bosses 22 are positioned along intermediate portions 26 of respective ones of handles 12 and are spaced from each other, and first bosses 22 are also movable relatively toward and away from each other as handles 14 are pivoted about pivot 16 toward and away from each other.

Similarly a pair of second bosses 30 are located forwardly of fulcrum embossment 18 to define a second connector-receiving channel 32 therewith. Second bosses 26 are joined to ends 34 of prongs 36 extending forwardly from forward ends 38 of handles 14 and joined thereto a distance laterally from pivot 16. Second bosses 30 are spaced from each other and are movable relatively away from and toward each other as handles 14 are pivoted about pivot 16 toward and away from each other.

First connector-receiving channel 24 is disposed across forward ends 38 of handles 14 and in operating face 20 of work end 12, with its sides defined by fulcrum embossment 18 on one side and first bosses 22 on the other. Similarly second connector-receiving channel 32 is disposed across prongs 36 and in operating face 20 of work end 12, with its sides defined by fulcrum embossment 18 on one side and second bosses 30 on the other. All of fulcrum embossment 18, first bosses 22 and second bosses 30 have cylindrical surfaces to facilitate bearing engagement with corresponding portions of connectors 100 during operation of tool 10. Preferably, first and second bosses 22,30 are spaced to correspond with recesses or indentations 140 of connectors 100 and thus are generally seated upon engagement with connectors 100 during operation of tool 10 for coupling and uncoupling of the connector assembly.

Figure 3:
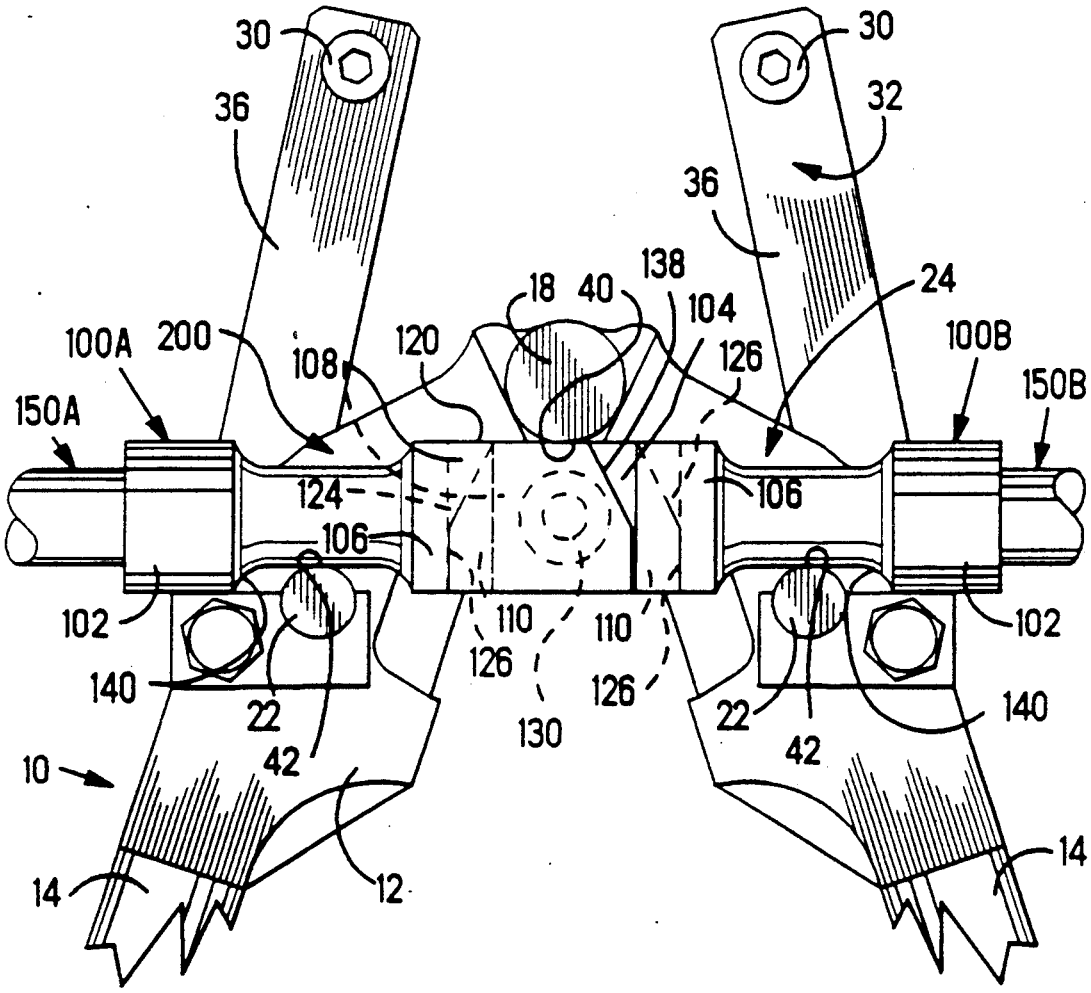
FIGS. 3 and 4 are diagrammatic views of a coupled connector assembly being uncoupled by the tool of FIG. 2.
Figure 4:
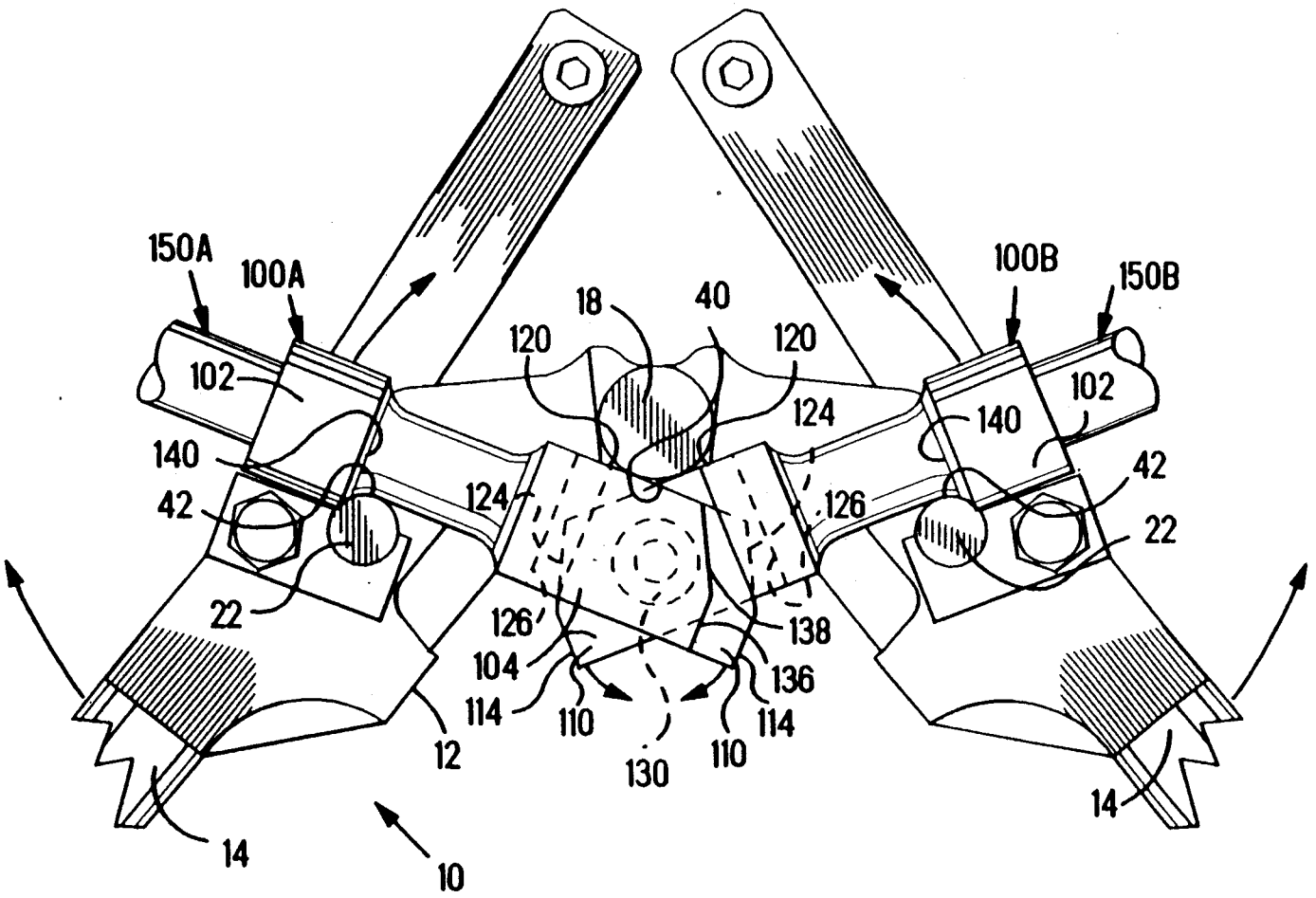

Referring to FIGS. 3 and 4, a coupled connector assembly 200 has been disposed along first connector-receiving channel 24 to be uncoupled by use of tool 10. Cylindrical bearing surface portion 40 of fulcrum embossment 18 is in engagement with side surfaces 120 of superposed forward sections 108 of the coupled connectors 100A,100B. Cylindrical bearing surface portions 42 of first bosses 22 are in engagement with surface portions of rearward sections 102 of the connectors and also within indentations 140 thereof whereat the connectors have been crimpingly deformed for connection to conductors of respective cables 150A,150B. Coupled assembly 200 is oriented so that the axis of rotation of the connectors with respect to each other and through the center of coupling sections 130 is parallel to the tool pivot axis through fulcrum embossment 18, and the blade contact sections 110 are aligned to be parallel with operating face 20 of tool 10 and within respective blade-receiving recesses 126 of the other connector. As handles 14 are moved apart in FIG. 4, first bosses 22 engage rearward sections 102 of connectors 100A,100B and pivot them about fulcrum embossment 18, moving blade contact sections 110 laterally out from recesses 126 and thus uncoupling connectors 100A,100B. It can be observed in FIGS. 4 and 5 that forward sections 108 of connectors 100A,100B conclude in ledges 136 with blade contact end sections 110 extending forwardly thereof, and that ledges 136 include beveled surfaces 138; both beveled surfaces 138 and angled surfaces 124 of blade contact end sections permit clearance with regard to opposing surfaces of base sections 106 and bottoms of recesses 126 during rotation of connectors 100A,100B with respect to each other.

Figure 5:
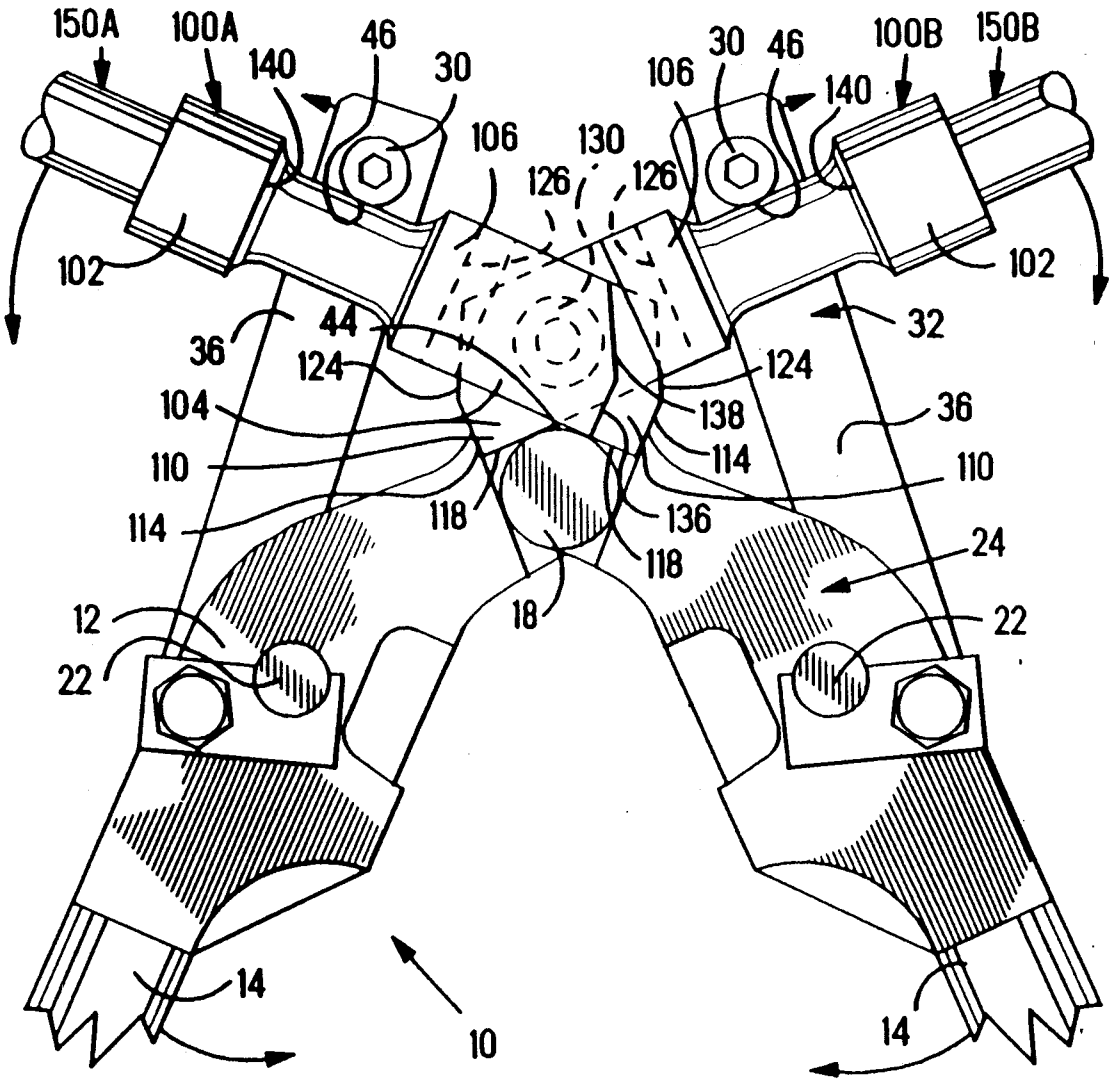
FIGS. 5 and 6 are diagrammatic views of an uncoupled connector assembly being coupled by the tool of FIG. 2.
Figure 6:
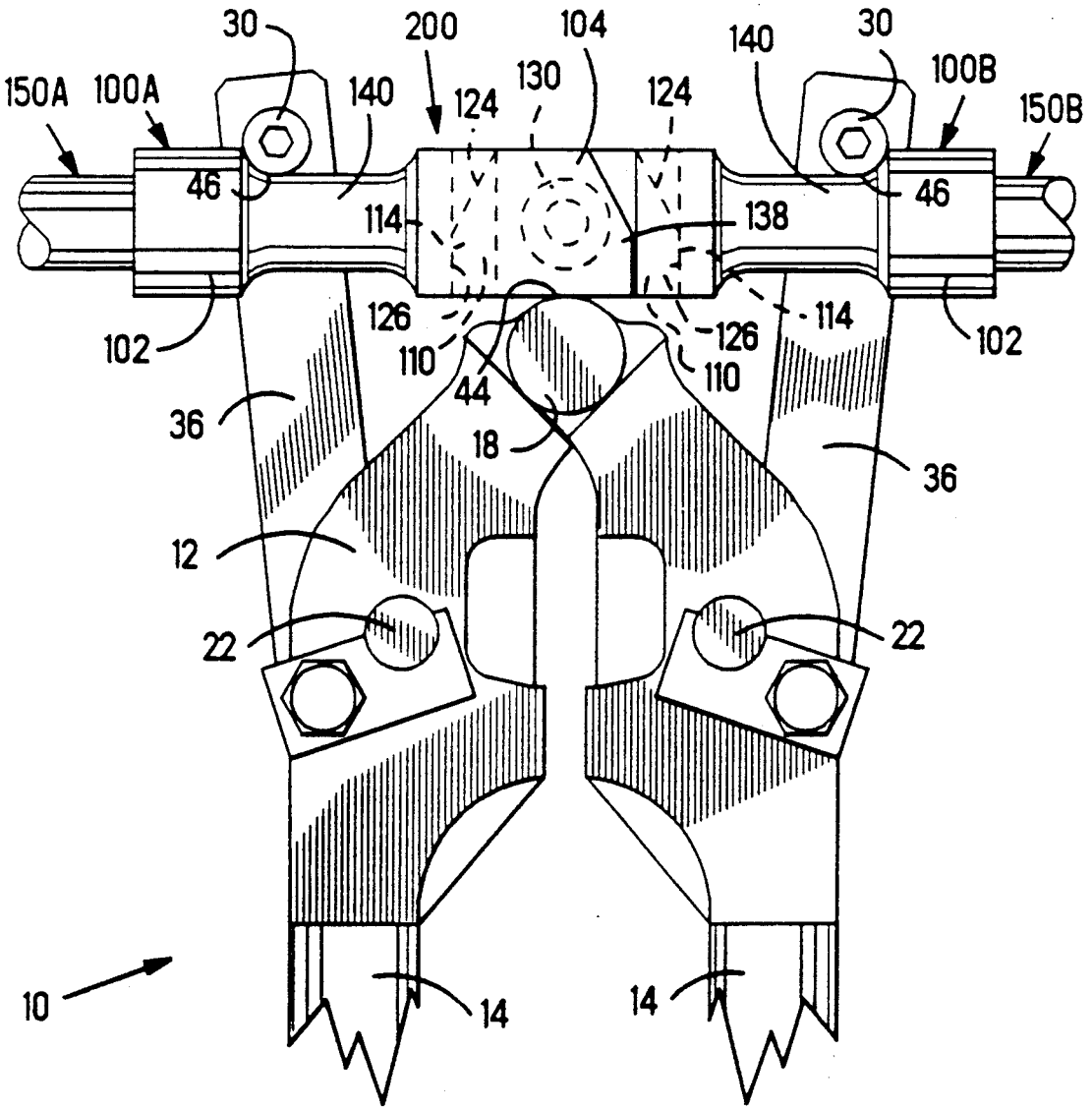

Referring now to FIGS. 5 and 6, connectors 100A,100B are shown being coupled using tool 10. In FIG. 5 the connectors are in an uncoupled relationship but oriented and deployed in precoupling engagement with coupling sections 130 in aligned engagement for coupling using tool 10 and disposed along second connector-receiving channel 32, such that the axis of rotation of the connectors through coupling sections 130 is parallel with the tool pivot axis through fulcrum embossment 18. Blade contact end portions 110 are positioned to enter blade-receiving recesses 126 when moved in a plane parallel to the operating face of work end 12 of the tool. Cylindrical bearing surface 44 of fulcrum embossment 18 is engaging side surfaces 118 of forward sections of the connectors, while cylindrical bearing surfaces 46 of second bosses 30 are in engagement with surface portions of connectors 100A,100B within indentations 140. As handles 14 are manipulated toward each other, second bosses 30 urge rearward connector sections 102 about the axis of rotation through aligned coupling sections 130, in cooperation with fulcrum embossment 18 abutting forward sections 104. Coupling is completed as shown in FIG. 6 when forward edge surfaces 114 of blade contact end sections 110 have been rotated into abutment with the bottom of blade-receiving recesses 126 of the other connector.

Tool 10 of the present invention is adapted to generate a mechanical advantage to apply the appropriate level of force at the appropriate positions on the connectors to relatively rotate them for either coupling or uncoupling, as desired, and using appropriate machine tool metal. Variations may occur in the design of certain aspects of the tool, such as providing shaped surfaces on the operating face of the tool along the connector-receiving channels to assist in seating the connectors therealong, or providing an additional pair of bosses on prongs 36 opposing second bosses 30 to assist in placement of the uncoupled connectors along second connector-receiving channel 32. The first and second bosses may initially be separate members secured to the work end of the tool in a variety of ways, or may be formed integrally with the two basic tool elements pivotably connected at pivot 16; and the prongs also may be similarly integral with the two basic tool elements separate components fastened thereto. The location of first and second bosses may be varied to accommodate different sizes of connectors to be coupled and uncoupled, or different locations of indentations as desired. All such modifications from the specific embodiment disclosed herein are within the spirit of the invention and the scope of the claims.

What is claimed is:

1. A tool for coupling and uncoupling connectors secured to end sections of electrical cables and adapted to be rotated in a common plane about an axis of rotation through forward sections of the connectors for coupling and uncoupling of blade contact sections with corresponding blade-receiving recesses, comprising:

a pair of elongate members secured together at forward ends thereof about a pivot and including rearward handles adapted to be manually manipulated about a tool pivot axis extending through said pivot during use, forward ends defining a work end having an operating face;

a fulcrum embossment extending outwardly from said operating face at said pivot and along said tool pivot axis;

a pair of first bosses spaced rearwardly from said fulcrum embossment and extending outwardly from said operating face to define a first connector-receiving channel in cooperation with said fulcrum embossment and intermediate sections of said elongate members, and said first bosses being spaced from each other a selected distance to engage rearward sections of said connectors when disposed along said first connector-receiving channel to be acted upon by said work end; and a pair of second bosses disposed on prongs extending forwardly from forward ends of said elongate members and forwardly of said fulcrum embossment, said second bosses extending outwardly from said operating face to define a second connector-receiving channel in cooperation with said fulcrum embossment and said prongs, and said second bosses being spaced from each other a selected distance to engage rearward sections of said connectors when disposed along said second connector-receiving channel to be acted upon by said work end, whereby said fulcrum embossment bearingly engages first side surfaces of forward sections of said connectors when said first bosses engage rearward sections of said connectors and said handles are pivoted to rotate said connectors to move said blade contact sections with respect to said blade-receiving recesses, and said fulcrum embossment bearingly engages second side surfaces of said forward sections when said second bosses engage rearward sections of said connectors and said handles are pivoted to rotate said connectors to move said blade contact sections with respect to said blade-receiving recesses.

2. The tool as set forth in claim 1 wherein said fulcrum embossment includes cylindrical bearing surfaces engageable with side edges of said connectors.

3. The tool as set forth in claim 1 wherein said first and second bosses include cylindrical bearing surface portions engageable with corresponding surface portions of said rearward sections of said connectors.

4. The tool as set forth in claim 1 wherein said first and second bosses are separate members fastened to respective portions of said work end of said tool.

5. The tool as set forth in claim 1 wherein said prongs are separate members fastened to respective forward ends of said elongate members.

6. The tool as set forth in claim 1 wherein said first bosses are located to engage said rearward connector sections when said handles are relatively together and said coupled connector assembly is appropriately positioned in said first connector-receiving channel to be uncoupled upon said handles being urged apart, and said second bosses are located to engage said rearward connector sections when said handles are relatively apart and said connectors are deployed and oriented in precoupling engagement and disposed in said second connector-receiving channel to be coupled upon said handles being urged together.

* * * * *

UNITED STATES PATENT AND TRADEMARK OFFICE

CERTIFICATE OF CORRECTION

PATENT NO. : 5,074,031

DATED : December 24, 1991

INVENTOR(S) : Walter M. Werner

It is certified that error appears in the above-identified patent and that said Letters Patent is hereby corrected as shown below:

On the title page, under section [21] Appl. No.: delete "323,750" and insert --732,375--.

Signed and Sealed this

Fourth Day of May, 1993

*Attest:*

Michael K. Kirk

MICHAEL K. KIRK

*Attesting Officer*

*Acting Commissioner of Patents and Trademarks*